US008764213B2

(12) United States Patent
Cammenga et al.

(10) Patent No.: US 8,764,213 B2
(45) Date of Patent: Jul. 1, 2014

(54) LIGHTED KNIFE DEVICE

(75) Inventors: John Cammenga, Holland, MI (US); Anthony Allan, Fennville, MI (US)

(73) Assignee: Bladetronics, LLC, Fennville, MI (US)

( * ) Notice: Subject to any disclaimer, the term of this patent is extended or adjusted under 35 U.S.C. 154(b) by 161 days.

(21) Appl. No.: 13/403,352

(22) Filed: Feb. 23, 2012

(65) Prior Publication Data

US 2013/0223045 A1 Aug. 29, 2013

(51) Int. Cl.
*B25B 23/18* (2006.01)

(52) U.S. Cl.
USPC ..... 362/119; 362/120

(58) Field of Classification Search
CPC ..... B26B 11/0008
USPC ..... 362/119, 120, 109; 30/122, 123
See application file for complete search history.

(56) References Cited

U.S. PATENT DOCUMENTS 3,831,276 A * 8/1974 Dalton et al. ..... 30/123
4,071,952 A * 2/1978 Meshulam et al. ..... 30/151
4,085,504 A * 4/1978 Nagy ..... 30/123
D353,011 S * 11/1994 Miller ..... D26/38
5,727,319 A * 3/1998 Myerchin et al. ..... 30/123
6,044,560 A * 4/2000 Chao ..... 30/123
7,726,031 B1 * 6/2010 Gibbs ..... 30/335
8,065,802 B2 * 11/2011 Oglesby et al. ..... 30/50
2004/0141313 A1 * 7/2004 Elsener ..... 362/119
2004/0187313 A1 * 9/2004 Zirk et al. ..... 30/123

* cited by examiner

*Primary Examiner* — Ali Alavi
(74) *Attorney, Agent, or Firm* — Bennet K. Langlotz; Langlotz Patent & Trademark Works, Inc.

(57) ABSTRACT

A lighted knife device has a knife blade, handle and a lighting device in a side of the handle and also there is a second lighting device arranged in mirror fashion. The first and second plurality of lighting devices are arranged at differing angles to light up an area underneath a blade edge. Alternatively, the first and second plurality of lighting devices are arranged at a same angle but also at a different angle such that the surface underneath a blade edge is lit up in a perpendicular fashion from sides of the blade. An energy storage device situated inside of a cavity within the handle contacting a tang blade portion. There is also a toggle switch contacting the energy device and the lighting devices of the banks of lighting devices through an internal switch of the toggle switch. The blade tang connected to each of the lighting devices.

21 Claims, 5 Drawing Sheets

LIGHTED KNIFE DEVICE

BACKGROUND (1) Field of the Invention

Relating to improvements in knives and lights, and more particularly relates to the combination of lights and knives that improve the visual perception for the user.

(2) Description of the Related Art

US Patent Citations: U.S. Pat. No. 4,751,621 granted to Jenkins teaches a light knife that helps a user to see at night. More particularly Jenkins has a knife provided with a light in its handle portion, with the light being actuated by a compression or threaded movement of a cap attached to an end of the handle. In a separate embodiment, the light may be actuated by a threaded movement of the handle end itself, while a protective cap may be positioned over the handle end and its associated light lens.

What Jenkins fails to teach, however, is how to use the knife part of his invention to cut an item and simultaneously using the light. Because the light is attached to the handle portion of his light knife it is impossible to view what you are using the knife on. Rather, the light is treated as a separate accessory to be used separately from the knife itself. Thus, an outdoorsman using the knife in the wilderness at night is forced to cut a piece of wood, prepare an animal or otherwise employ the knife in total darkness. This has the unfortunate side effects of precipitating injuries, badly cut meat from captured game or badly cut wood that would not serve for any specific use beyond firewood. There needs to be a solution to overcome the deficiency found in Jenkins.

BRIEF SUMMARY OF THE INVENTION

A lighted knife device has a knife blade connected to a handle and a lighting device forwardly directed to a cutting end of the knife blade, situated in a side of the handle, and proximate to the portion of the knife blade as it exits the handle. The lighting device is further situated to a side of the knife blade and there is a second lighting device forwardly directed to a cutting end of the knife blade, situated in an opposite side of the handle and proximate to the portion of the knife blade as it exits the handle. This second lighting device is further situated to an opposite side of the knife blade such that a second lighting device is forwardly directed to a cutting end of the knife blade, situated in an opposite side of the handle and proximate to the portion of the knife blade as it exits the handle. This second lighting device is further situated to an opposite side of the knife blade. The lighting device is made of a first plurality of lighting devices arranged in the handle following the height of the blade from its lengthwise cutting edge to its opposite face on top of the blade. There is also a second plurality of lighting devices arranged in the handle following the height of the blade from its lengthwise cutting edge to its opposite face on top of the blade such that the second plurality of lighting devices are arranged on the opposite side of the handle. In one embodiment, the first plurality of lighting devices are arranged at differing angles when measured from an axis extending longitudinally down a length of the blade and following a blade height such that the lighting devices light up an area underneath a blade cutting edge from a forward portion of the blade to the back of the blade near the handle thereby preventing shadows under the blade. The second plurality of lighting devices are arranged at differing angles when measured from an axis extending longitudinally down a length of the blade and following a blade height such that the second bank of lighting devices light up an area underneath a blade cutting edge from a forward portion of the blade to the back of the blade near the handle thereby preventing shadows under the blade. In another embodiment, the first plurality of lighting devices are arranged at a same angle when measured from an axis extending longitudinally down a length of the blade and following a blade height but also each lighting device of the first plurality of lighting device also arranged at a different angle when measured from an axis extending longitudinally down the length of the blade and following a blade thickness such that the lighting devices light up an area perpendicular to the blade wide flat surface on one side of the blade such that the surface underneath a blade cutting edge is lit up in a perpendicular fashion from one side of the blade. This other embodiment also has the second plurality of lighting devices are arranged at a same angle when measured from an axis extending longitudinally down a length of the blade and following a blade height but also each lighting device of the second bank of lighting devices also arranged at a different angle when measured from an axis extending longitudinally down the length of the blade and following a blade thickness such that the lighting devices light up an area perpendicular to the blade wide flat surface on another side of the blade such that the surface underneath a blade cutting edge is lit up in a perpendicular fashion from another side of the blade. Other features that should be appreciated that there is an energy storage device situated inside of a cavity within the handle and in physical contact with a tang portion of the knife blade. There is also a toggle switch in direct physical contact with the energy storage device and connected to each of the lighting devices of the banks of lighting devices through an internal switch. Finally, the device is arranged such that the tang portion of the blade is connected to each of the lighting devices of the banks of lighting devices.

A lighted knife device has a handle defining a cavity a knife blade including an extending portion having a sharpened edge, and an integral tang portion received within the cavity of the knife handle an energy storage device situated in the cavity of the knife handle and in physical contact with a tang portion of the knife blade a lighting device forwardly directed to a cutting end of the knife blade, situated in a side of the handle, and proximate to the portion of the knife blade as it exits the handle such that the tang portion of the knife blade is connected to the lighting device. Also, there is a switch that is connected to the lighting device and to the opposite pole of the energy storage device. It should be understood that the lighting device in an embodiment comprises a bank of lighting devices. Finally, the device has another bank of lighting devices forwardly directed to a cutting end of the knife blade, situated in another side of the handle, and proximate to the portion of the knife blade as it exits the handle such that the tang portion of the knife blade is connected to the lighting device.

A lighted knife device has a knife blade connected to a handle and a lighting device forwardly directed to a cutting end of the knife blade, situated in a side of the handle, and proximate to the portion of the knife blade as it exits the handle and a second lighting device forwardly directed to a cutting end of the knife blade, situated in an opposite side of the handle, and proximate to the portion of the knife blade as it exits the handle such that shadowing is prevented underneath the blade.

DETAILED DESCRIPTION OF THE INVENTION

Figure 1A:
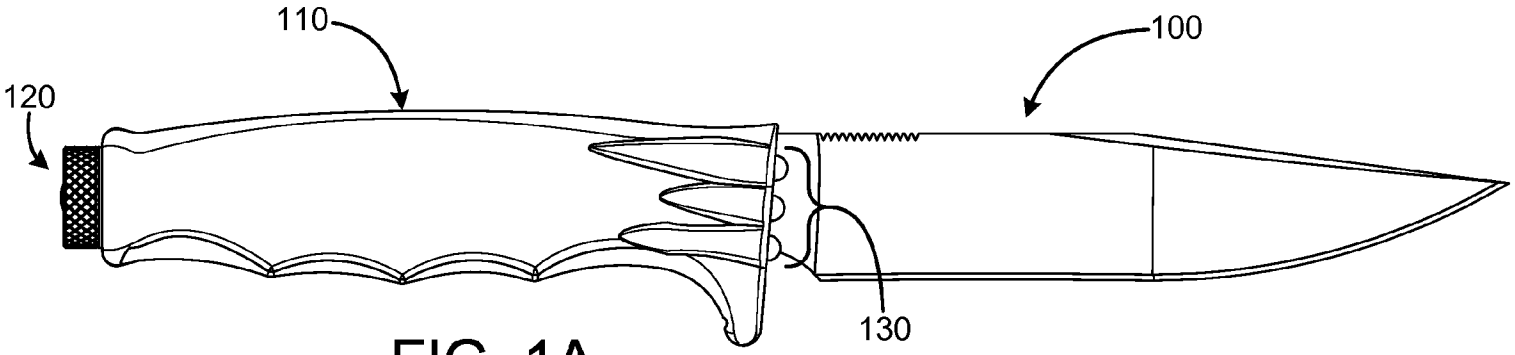
FIG. 1 illustrates a side view and cross-sectional side view of an embodiment of an improved lighted knife device.

FIG. 1 illustrates a side view and cross-sectional side view of an embodiment of a lighted knife device. FIG. 1*a* shows a side view of the main components of the knife flashlight of the instant embodiment having a blade 100, a handle 110 made from two complementary handle portions, a push button toggle switch 120 and external fins 130 having light emitting diodes (LEDs) situated therein. The blade 100 is made from any suitable man made material such as stainless steel, titanium, laminates and more; the handle 110 is made from suitable manmade materials such as wood, plastics, stainless steel, aluminum, polyphthalamide that is optionally reinforced with kevlar or fiberglass or more. The toggle switch is screw in ON-OFF type switch that opens or closes a circuit and is custom made directly with external markings fitting the environment and style where the knife is to be used. Finally, there are three external fins on each side of the handle to make a total of six fins; these are located just behind the external portion of the blade closest to the handle on either handle piece. These fins 130 are molded or cut as part of the handle and are hollowed out to permit the insertion and securing of light emitting diodes LEDs therein.

Figure 1B:
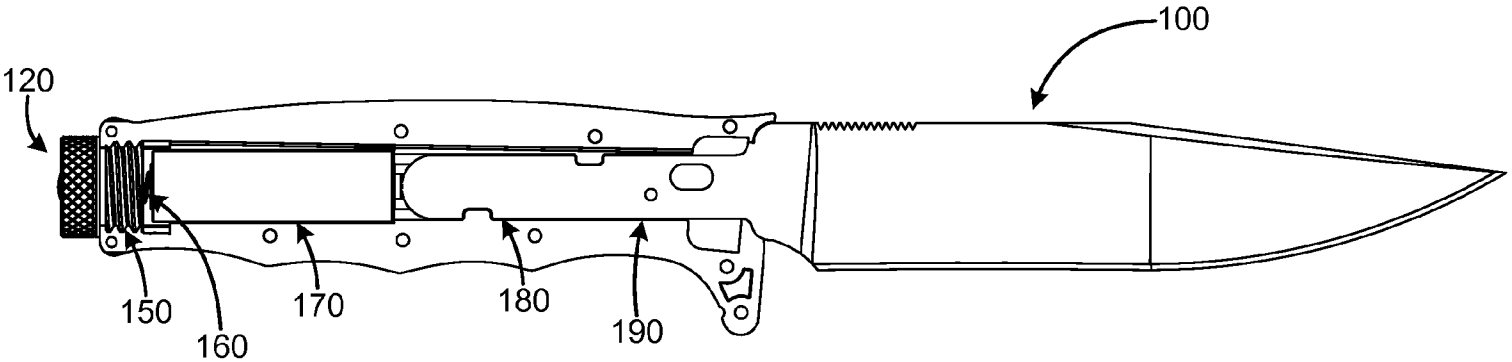

FIG. 1*b* illustrates a cross-sectional side view of an embodiment of a knife flashlight device; more particularly, it shows one of the complementary portions of the handle 110 from FIG. 1*a* that are held along with its complement by screws, pins, adhesives or similar connecting mechanisms as well as the contents therein. The handle 110 that is formed by two complementary portions has a longitudinal hollow 190 for the insertion of various components to be described herein. The blade 100 described previously extends inwards through a hollow portion 190 of the handle 110 so that this portion or 'tang' 180 if you prefer extends inwards and is in direct physical contact with the positive terminal of battery 170 that is similarly situated in hollow portion 190 but on the other side of inwardly directed protrusions. It should be noted that these inward protrusions separate the battery 170 and tang 180 so that the tang 180 and the rest of the blade 100 do not slide backwards into the handle further than it should. Of course there is sufficient clearance in between the protrusions to permit the entry of the positive terminal of the battery 170 and thereby facilitate contact with tang 180. Battery 170 is a typical 'AA' battery that and any different DC source is substituted based upon the needs of the implementation; i.e., 'AAA', a set of disk batteries connected appropriately etcetera.

To make the current flow in the circuit using battery 170, toggle switch 120 has male terminals 160 representing the output terminals of the switch that are in physical contact with the negative terminals of the battery 170. When the button 120 is switched between OFF to ON then the electrical connection internal to the Toggle switch 120 is activated permitting current to flow out of the two terminals 160 as will be described with reference to FIG. 4. The toggle switch 120 also has threads 150 that correspond with grooves so as to permit the screwing of the switch 120 into the handle 110 once the two complementary portions of the handle 110 have been permanently connected. In this fashion, the toggle switch 120 can be unscrewed and a fresh battery replace an old one once the old one has been de-energized.

Figure 2A:
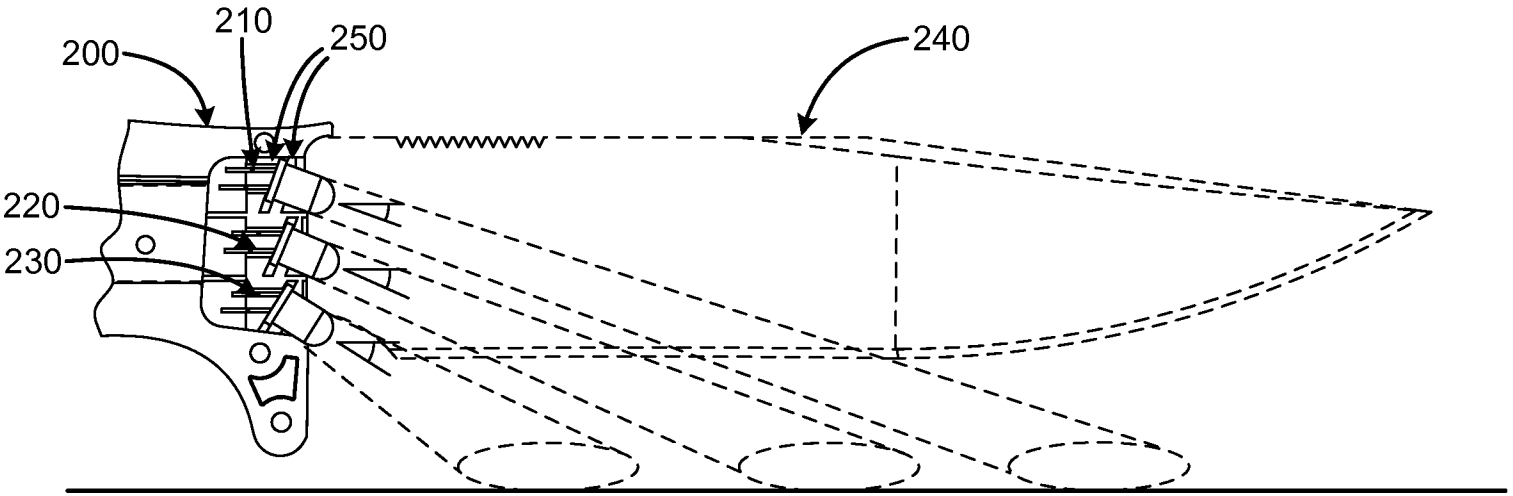
FIG. 2 illustrates a cross-sectional close-up of the effect of various light emitting diode (LED) dispositions according to embodiments of an improved lighted knife device.

FIG. 2 illustrates a cross-sectional close-up of the effect of various light emitting diode (LED) dispositions according to embodiments of a lighted knife device. More particularly FIG. 2*a* shows a portion of the handle 200 is shown have a triple bank of LEDs at the forward section of the handle 200. Once light is switched on in the circuit, the current flows and the LEDs light up. A set of three LEDs 210, 220, 230 are shown in FIG. 2*a* and have a corresponding set of LEDs attached similarly on the other complementary side of the handle 200. In FIG. 2*a* each of the LEDs are disposed at a slightly different angle such that the top LED 210 is at a smaller angle to the horizontal then the next LED 220 and then the LED 220 is at a smaller angle to the horizontal than the next LED 230. The effect of this configuration is to permit the spreading of the light directly underneath the blade 240 as shown in the figure having a coverage from the front of the blade to the back of the blade or at least a portion of this region.

Figure 2B:
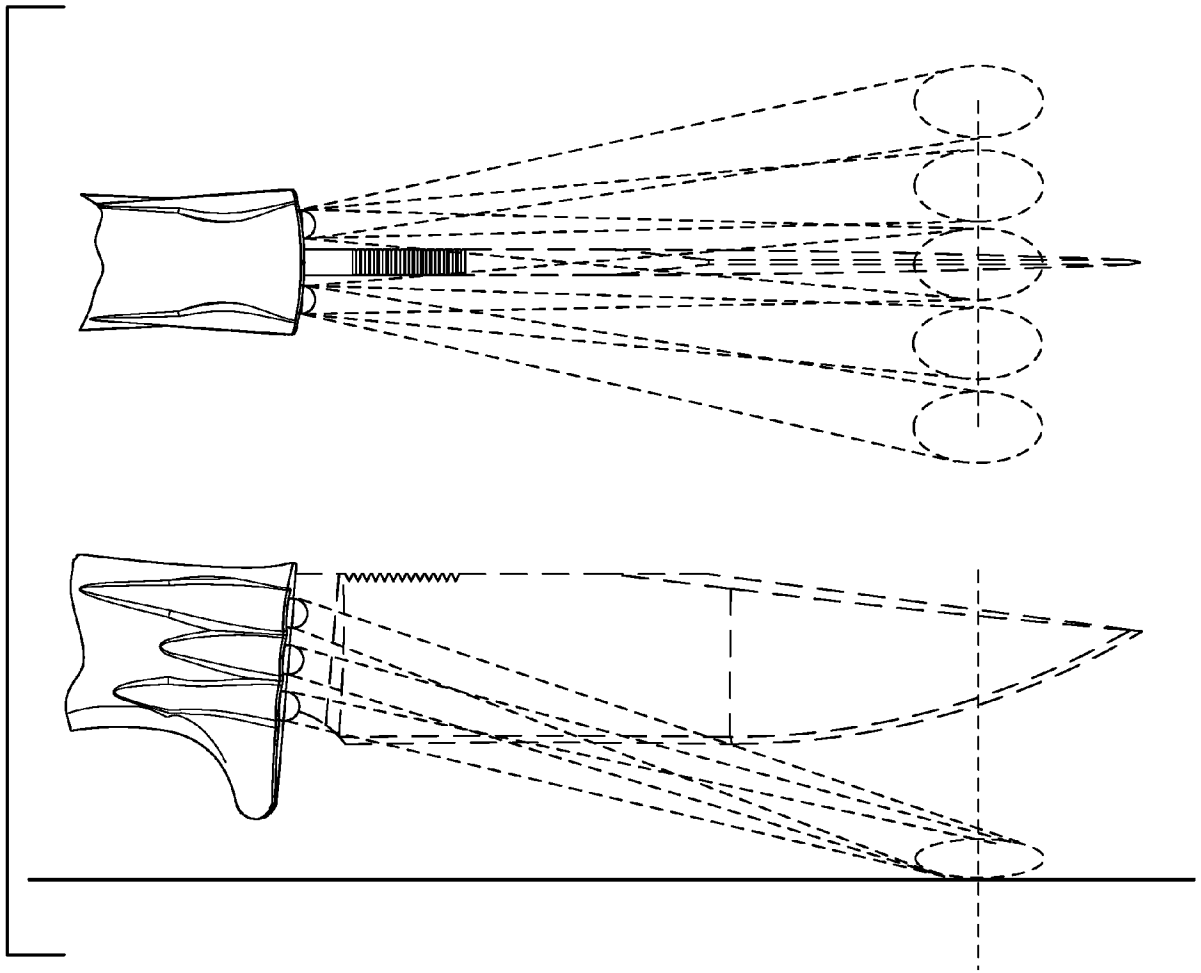

FIG. 2*b* shows a configuration of LEDs that spreads the light underneath the blade 240 but in a straight line. This is made possible by using the same angle to the horizontal on each LED but using a different angle on each LED to the surface of the LED plane. The light spreads out maximally at approximately a point that would be the most important cutting point and falls off further away from that zone forwards or backwards of that zone as seen from the top view in the FIG. 2*b*. Each of the LEDs is situated within fins that spread outside of the complementary handle portions and have two inwardly directed circular protrusions 250 for each individual set of LEDs. These two circular protrusions (one is part of the internal structure of the fin and prevents the LED from falling out forwards) help anchor the LED in place since one is of such a size that it does not permit the LED to move backwards and the other prevents forwards motion as it is too small to permit the head or neck ledge to slide outwards under ordinary usage. Of course, in the event that sufficient pressure or force is applied the LED can be forced out since the protrusions are pliable enough to permit a user to replace the LED but not so that they can disengage the LED during ordinary usage. Alternatively, instead of the dual circular protrusions the LEDs are held in place by the forward protrusion that is integral with the internal structure of the fins and the grasping of the legs of each side with finely leg-threaded protrusions that extend from each inner side, adhesive or similar types of attachments.

Figure 3:
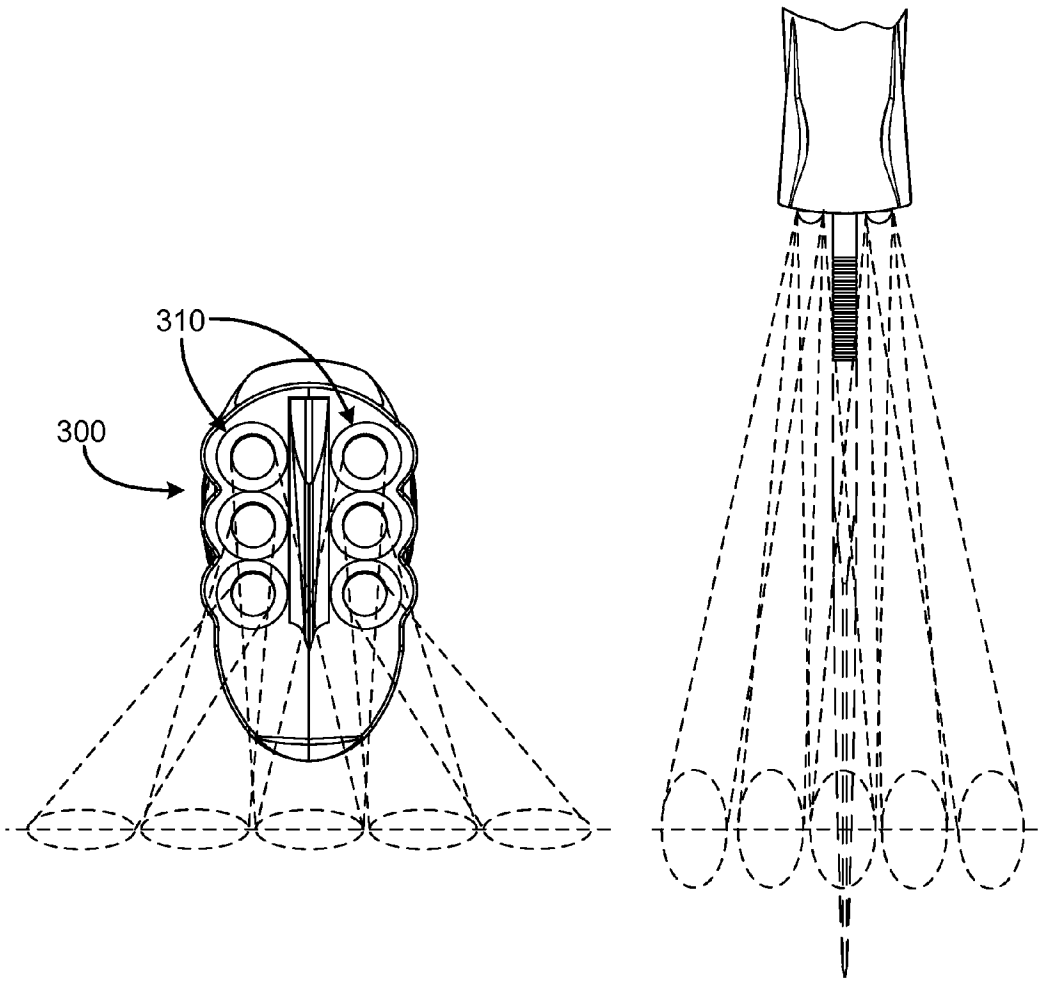
FIG. 3 illustrates a head-on view of an embodiment of a lighted knife device device showing the effect of a spread or splaying pattern for the LEDs.

FIG. 3 illustrates a head-on view of an embodiment of a lighted knife device showing the effect of a spread or splaying pattern for the LEDs. Two triple banks of LEDs are situated in the fins described previously in the forward section of two handle portions 300 that have been assembled with the intervening blade as shown. A splayed coverage area is shown directly underneath the blade such that a line of coverage extends perpendicularly to the blade from one side under the blade and perpendicularly onto the other side of the blade. The bottom LED on each side is angled slightly more than the one above it away from the blade and the next one up is slightly more angled than the topmost LED. In this fashion a perpendicular zone of light coverage spreads out directly underneath the blade. The coverage of the lights from the topmost LEDs has been illustrated combined at the most useful cutting point under the blade other spreads are possible whereby the two light rays combine edge to edge directly underneath the blade rather than being totally in unison or even a partial unison of two light coverage rays or zones.

Figure 4:
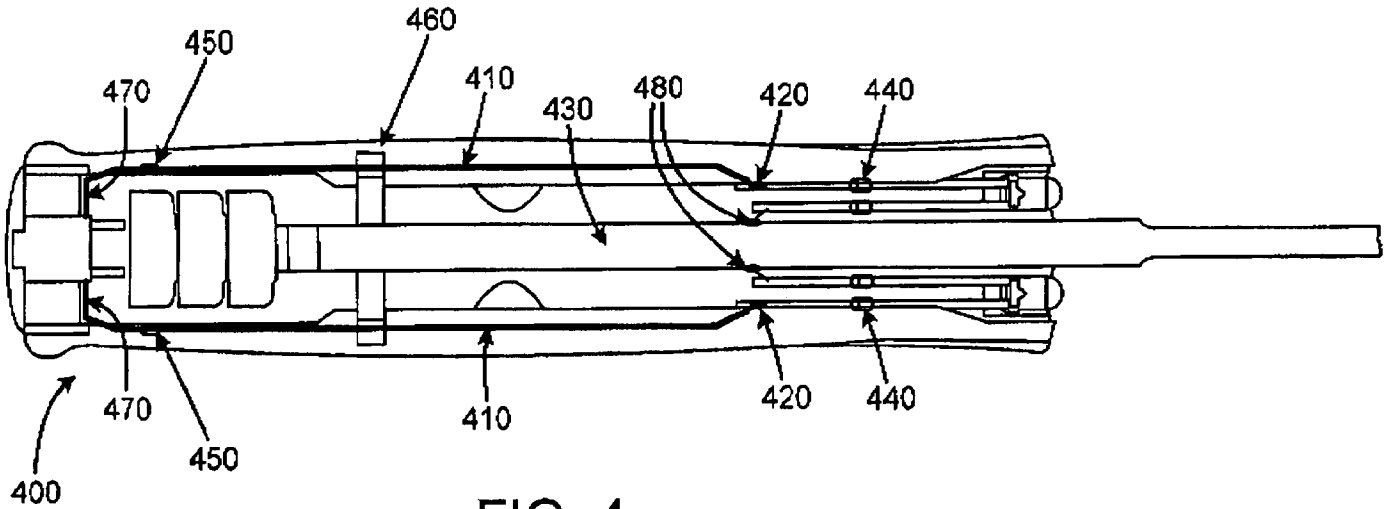
FIG. 4 illustrates a top cross-sectional view of an embodiment of the lighted knife device showing the internal components and how they interrelate to effect the lighting effect.

FIG. 4 illustrates a top cross-sectional view 400 of an embodiment of lighted knife device showing the internal components and how they interrelate to effect the lighting effect. A metal wire or insulated lead 410 is welded to a leg of the LED on each side of the complementary handles. This lead or wire is held in place by protrusions 440 and 450 on either side of the complementary handle portions. These protrusions are tiny cylinders through which a lead may be threaded. Alternatively, a large protrusion covers the wire or lead longitudinally down the entire necessary length to effect the physical contact with the energizing components. The connector, wire, or lead 410 is connected on its opposite end to terminals 470 of the toggle switch such that when the switch is turned ON then electricity will flow through the male prongs of the switch and if turned OFF then no electricity will flow through the male prongs of the switch.

The other end of the LEDS are connected to the tang 430 of the blade at weld points 480. Thus, electricity flows from the battery through an ON switch male prongs through the switch terminals 470, through one LED, through the tang and back down the other terminal of the battery. The same happens on the other LED situated in the complementary handle portion. Additionally, it should be appreciated that the wiring scheme applies to the other four LEDs of the two complementary banks of LEDs. Finally, there is a set if protrusions 460 that extend from the inner surface of the complementary handles that help hold the blade stationary and do not permit it to dance inside the handle complements. It should be understood that the blade is held in place by notches therein. These notches have a holding mechanism with tongues or protrusions that extend from within the internal structure of the complementary handle portions.

Finally, while there has been shown and described the preferred embodiment of the instant invention it is to be appreciated that the invention may be embodied otherwise than is herein specifically shown and described and that, within said embodiment, certain changes may be made in the form without departing from the underlying ideas or principles of this invention as set forth in the Claims appended herewith.

We claim:

1. A lighted knife device comprising:

a knife blade connected to a handle;

a lighting device forwardly directed to a cutting end of the knife blade, situated in a side of the handle, and proximate to the portion of the knife blade as it exits the handle;

a second lighting device forwardly directed to a cutting end of the knife blade, situated in an opposite side of the handle and proximate to the portion of the knife blade as it exits the handle; and wherein the lighting device comprises a first plurality of lighting devices arranged in the handle following the height of the blade from its lengthwise cutting edge to its opposite face on top of the blade.

2. The lighted knife device of claim 1, further comprising: the lighting device is further situated to a side of the knife blade.

3. The lighted knife device of claim 1, wherein the lighting devices are arranged in mirror fashion.

4. The lighted knife device of claim 1, further comprising: the second lighting device is further situated to an opposite side of the knife blade.

5. The lighted knife device of claim 1, further comprising: a second lighting device forwardly directed to a cutting end of the knife blade, situated in an opposite side of the handle and proximate to the portion of the knife blade as it exits the handle.

6. The lighted knife device of claim 5, further comprising: the second lighting device is further situated to an opposite side of the knife blade.

7. The lighted knife device of claim 1, wherein the first plurality of lighting devices are arranged at differing angles when measured from an axis extending longitudinally down a length of the blade and following a blade height such that the lighting devices light up an area underneath a blade cutting edge from a forward portion of the blade to the back of the blade near the handle thereby preventing shadows under the blade.

8. The lighted knife device of claim 1, further comprising: a second plurality of lighting devices arranged in the handle following the height of the blade from its lengthwise cutting edge to its opposite face on top of the blade such that the second plurality of lighting devices are arranged on the opposite side of the handle.

9. The lighted knife device of claim 8, wherein the second plurality of lighting devices are arranged at differing angles when measured from an axis extending longitudinally down a length of the blade and following a blade height such that the second bank of lighting devices light up an area underneath a blade cutting edge from a forward portion of the blade to the back of the blade near the handle thereby preventing shadows under the blade.

10. The lighted knife device of claim 8, wherein the second plurality of lighting devices are arranged at a same angle when measured from an axis extending longitudinally down a length of the blade and following a blade height but also each lighting device of the second bank of lighting devices also arranged at a different angle when measured from an axis extending longitudinally down the length of the blade and following a blade thickness such that the lighting devices light up an area perpendicular to the blade wide flat surface on another side of the blade such that the surface underneath a blade cutting edge is lit up in a perpendicular fashion from another side of the blade.

11. The lighted knife device of claim 8, further comprising: an energy storage device situated inside of a cavity within the handle and in physical contact with a tang portion of the knife blade.

12. The lighted knife device of claim 11, further comprising:

a toggle switch in direct physical contact with the energy storage device and connected to each of the lighting devices of the banks of lighting devices through an internal switch.

13. The lighted knife device of claim 11, such that the tang portion of the blade is connected to each of the lighting devices of the banks of lighting devices.

14. The lighted knife device of claim 1, wherein the first plurality of lighting devices are arranged at a same angle when measured from an axis extending longitudinally down a length of the blade and following a blade height but also each lighting device of the first plurality of lighting devices also arranged at a different angle when measured from an axis extending longitudinally down the length of the blade and following a blade thickness such that the lighting devices light up an area perpendicular to the blade wide flat surface on one side of the blade such that the surface underneath a blade cutting edge is lit up in a perpendicular fashion from one side of the blade.

15. A lighted knife device comprising:

a handle defining a cavity;

a knife blade including an extending portion having a sharpened edge, and an integral tang portion received within the cavity of the knife handle;

an energy storage device situated in the cavity of the knife handle and in physical contact with a tang portion of the knife blade;

a bank of lighting devices forwardly directed to a cutting end of the knife blade, situated in a side of the handle, and proximate to the portion of the knife blade as it exits the handle such that the tang portion of the knife blade is connected to the lighting device;

another bank of lighting devices forwardly directed to a cutting end of the knife blade, situated in another side of the handle, and proximate to the portion of the knife blade as it exits the handle such that the tang portion of the knife blade is connected to the lighting device; and a switch that is connected to the lighting device and to the opposite pole of the energy storage device.

16. A lighted knife device comprising:

a knife blade connected to a handle; and a lighting device forwardly directed to a cutting end of the knife blade, situated in a side of the handle, and proximate to the portion of the knife blade as it exits the handle;

wherein the lighting device comprises a first plurality of lighting devices arranged in the handle following the height of the blade from its lengthwise cutting edge to its opposite face on top of the blade.

17. The lighted knife device of claim 16, wherein the first plurality of lighting devices are arranged at differing angles when measured from an axis extending longitudinally down a length of the blade and following a blade height such that the lighting devices light up an area underneath a blade cutting edge from a forward portion of the blade to the back of the blade near the handle thereby preventing shadows under the blade.

18. The lighted knife device of claim 16, wherein the first plurality of lighting devices are arranged at a same angle when measured from an axis extending longitudinally down a length of the blade and following a blade height but also each lighting device of the first plurality of lighting devices also arranged at a different angle when measured from an axis extending longitudinally down the length of the blade and following a blade thickness such that the lighting devices light up an area perpendicular to the blade wide flat surface on one side of the blade such that the surface underneath a blade cutting edge is lit up in a perpendicular fashion from one side of the blade.

19. The lighted knife device of claim 16 further comprising:

a second lighting device forwardly directed to a cutting end of the knife blade, situated in an opposite side of the handle, and proximate to the portion of the knife blade as it exits the handle such that shadowing is prevented underneath the blade; and wherein the second light device comprises a second plurality of lighting devices arranged in the handle following the height of the blade from its lengthwise cutting edge to its opposite face on top of the blade such that the second plurality of lighting devices are arranged on the opposite side of the handle.

20. The lighted knife device of claim 18, wherein the second plurality of lighting devices are arranged at differing angles when measured from an axis extending longitudinally down a length of the blade and following a blade height such that the second bank of lighting devices light up an area underneath a blade cutting edge from a forward portion of the blade to the back of the blade near the handle thereby preventing shadows under the blade.

21. The lighted knife device of claim 18, wherein the second plurality of lighting devices are arranged at a same angle when measured from an axis extending longitudinally down a length of the blade and following a blade height but also each lighting device of the second bank of lighting devices also arranged at a different angle when measured from an axis extending longitudinally down the length of the blade and following a blade thickness such that the lighting devices light up an area perpendicular to the blade wide flat surface on another side of the blade such that the surface underneath a blade cutting edge is lit up in a perpendicular fashion from another side of the blade.

* * * * *